United States Patent [19]

Watanabe et al.

[11] 4,310,623

[45] Jan. 12, 1982

[54] COLOR PHOTOGRAPHIC LIGHT-SENSITIVE MATERIAL

[75] Inventors: Toshiyuki Watanabe; Masakazu Morigaki, both of Minami-ashigara, Japan

[73] Assignee: Fuji Photo Film Co., Ltd., Kanagawa, Japan

[21] Appl. No.: 216,714

[22] Filed: Dec. 15, 1980

[30] Foreign Application Priority Data

Dec. 14, 1979 [JP] Japan ..... 54-163167
Dec. 14, 1979 [JP] Japan ..... 54-163168

[51] Int. Cl.[3] ..... G03C 1/48; G03C 1/40

[52] U.S. Cl. ..... 430/505; 430/380; 430/546; 430/551; 430/555; 430/566

[58] Field of Search ..... 430/505, 380, 546, 555, 430/566, 551

[56] References Cited

U.S. PATENT DOCUMENTS

| | | | |
|---|---|---|---|
| 3,552,966 | 1/1971 | Kuhn et al. | 430/380 |
| 3,705,035 | 12/1972 | Vetter et al. | 430/380 |
| 4,203,767 | 5/1980 | Fujiwhara et al. | 430/566 |
| 4,264,723 | 4/1981 | Ichijima et al. | 430/555 |

*Primary Examiner*—J. Travis Brown
*Attorney, Agent, or Firm*—Sughrue, Mion, Zinn, Macpeak & Seas

[57] ABSTRACT

A color photographic light-sensitive material is described, comprising a support having thereon a silver halide emulsion layer containing at least one coupler represented by formula (I)

(I)

wherein $R_1$ represents an anilino group, an acylamino group or a ureido group, $R_2$ represents an aralkyl group, an alkyl group, or an alkenyl group, $X_1$, $X_2$, and $X_3$ each represents hydrogen, an alkyl group, a halogen atom, an alkoxy group, an aryloxy group, an acylamino group, a carbamoyl group, a sulfamoyl group, a sulfonyl group or a cyano group and $X_1$, $X_2$, and $X_3$ may be the same or different, and at least one of said silver halide emulsion layer and a hydrophilic colloid layer adjacent thereto containing a 1-phenyl-3-pyrazolidone compound having a diffusion resistant group in the presence of an organic solvent having a high boiling point for a photographic additive.

The photographic light-sensitive material provides a magenta color image having a high sensitivity.

More preferably, said color photographic light-sensitive material further contains a hydroquinone compound in at least one of said silver halide emulsion layer and said hydrophilic colloid layer adjacent thereto.

The photographic light-sensitive material provides a magenta color image having a high sensitivity without forming undesired fog using relatively low amounts of silver.

24 Claims, No Drawings

COLOR PHOTOGRAPHIC LIGHT-SENSITIVE MATERIAL

BACKGROUND OF THE INVENTION

The present invention relates to a color photographic light-sensitive material and particularly to a color photographic light-sensitive material wherein the dye formation efficiency in the color development step is high and the increase in sensitivity is obtained.

It is known that, upon color development of a silver halide color photographic material, an oxidized aromatic primary amine type color developing agent reacts with a coupler to form an indophenol, indoaniline, indamine, azomethine, phenoxazine, phenazine or like dye, thereby forming color image. In such a system, color reproduction is usually based on a subtractive method, and silver halide emulsions selectively sensitive to blue, green, and red light, respectively, and yellow, magenta, and cyan color image-forming compounds which are in a complementary color relation to the sensitivity of the respective emulsions are employed. For example, acylacetanilide or dibenzoylmethane type couplers are generally used for the formation of a yellow color image, pyrazolone, pyrazolobenzimidazole, cyanoacetophenone and indazolone type couplers are generally used for the formation of magenta color images, and phenolic type couplers (e.g., phenols and naphthols) are generally used for the formation of cyan color images.

Many conventional color-image-forming couplers are 4-equivalent couplers. That is, the development of 4 mols of silver halide as an oxidizing agent is theoretically necessary to form 1 mol of dye through the coupling reaction. On the other hand, 2-equivalent couplers are also known, having an active methylene group substituted with a group eliminatable upon oxidative coupling of the coupler with an oxidation product of an aromatic primary amine developing agent. Such 2-equivalent couplers require the development of only 2 mols of silver halide to form 1 mol of dye. Since 2-equivalent couplers require only one-half the silver halide as compared with conventional 4-equivalent couplers to form a dye, their use enables rapid processing of light-sensitive materials because it allows for a reduction in a thickness of light-sensitive layers, resulting improvement of the photographic properties due to the reduction in film thickness, and results in economic advantages.

Several approaches have thus been suggested to produce 2-equivalent couplers from 5-pyrazolone type couplers, which have primarily been used as magenta-forming couplers. For example, the substitution of the 4-position of a pyrazolone: with a thiocyano group is described in U.S. Pat. Nos. 3,214,437 and 3,253,924; with an acyloxy group is described in U.S. Pat. No. 3,311,476; with an aryloxy group is described in U.S. Pat. No. 3,419,391; with a 2-triazolyl group is described in U.S. Pat. No. 3,617,291; and with a halogen atom is described in U.S. Pat. No. 3,522,052.

However, in using these 4-position substituted pyrazolone couplers, there are disadvantages, e.g., serious color fog may result; the reactivity of the couplers may be unsuitable; the couplers may be chemically so unstable that they are converted to materials incapable of color formation with the lapse of time; or synthesis of the couplers is often difficult.

Also, it has hitherto been known to substitute the 4-position of a 5-pyrazolone with an alkylthio group, an arylthio group, or a heterocyclic ring thio group, as described in U.S. Pat. No. 3,227,554. However, with many of these known thio-substituted pyrazolone compounds, the reactivity with the oxidation product of an aromatic primary amine color developing agent is unsuitable and, further, they are difficult to employ in ordinary color light-sensitive materials due to the strong photographic action of the mercapto compound produced as a result of the coupling reaction. In addition, the chemical stability of these couplers is not generally satisfactory.

Further, recently, a high sensitive color photographic light-sensitive material is highly required. But the color sensitivity obtained from the above-described 2-equivalent magenta couplers is not sufficient to produce highly sensitive color photographic light-sensitive materials. Thus, it has been strongly desired to develop a technique for increasing a sensitivity of a magenta color image-forming layer.

Recently, it has been found that a magenta coupler having an alkylthio coupling-off group possesses an extraordinarily high activity and a high color sensitivity (see Japanese Patent Application No. 136497/78, corresponding to U.S. Ser. No. 91,663, filed on Nov. 5, 1979, now U.S. Pat. No. 4,264,723). However, this is still insufficient for obtaining highly sensitive color photographic light-sensitive materials.

SUMMARY OF THE INVENTION

Therefore, an object of the present invention is to provide a color photographic light-sensitive material having a magenta color image-forming layer which contains a reduced amount of coated silver and provides a high color sensitivity.

Another object of the present invention is to improve the preservability of a photographic light-sensitive material containing a magenta coupler having an alkylthio coupling-off group.

A further object of the present invention is to improve the light fastness and the durability of a dye formed from a magenta coupler having an alkylthio coupling-off group.

These and other objects of the present invention will become more apparent from the following detailed description and examples.

These objects of the invention are attained by a color photographic light-sensitive material comprising a support having thereon a silver halide emulsion layer containing at least one coupler represented by formula (I)

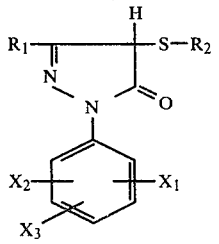

(I)

wherein $R_1$ represents an anilino group, an acylamino group or a ureido group, $R_2$ represents an aralkyl group, an alkyl group or an alkenyl group, $X_1$, $X_2$, and $X_3$ each represents hydrogen, an alkyl group, a halogen atom, an alkoxy group, an aryloxy group, an acylamino group, a carbamoyl group, a sulfamoyl group, a sulfonyl group, or a cyano group, and at least one of said silver halide emulsion layer and a hydrophilic colloid layer adjacent thereto containing a 1-phenyl-3-pyrazolidone compound having a diffusion resistant group in the presence of an organic solvent having a high boiling point for a photographic additive.

DETAILED DESCRIPTION OF THE INVENTION

It is preferred to dissolve a mixture of a coupler represented by formula (I) and a diffusion resistant oil-soluble 1-phenyl-3-pyrazolidone derivative in an organic solvent having a high boiling point for a photographic additive and to disperse these components in a silver halide emulsion layer to obtain the effects of the present invention.

By a combination of only a coupler represented by formula (I) and a diffusible 1-phenyl-3-pyrazolidone derivative, or by a method in which a diffusion resistant 1-phenyl-3-pyrazolidone derivative is dissolved in an organic solvent having a low boiling point, such as methanol, etc., and added to a silver halide emulsion, the above-described objects of the present invention cannot be achieved.

The magenta coupler (i.e., magenta dye-forming coupler) used in the present invention is preferably represented by formula (I)

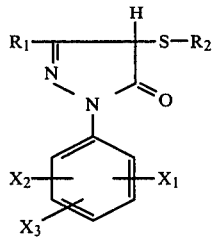

(I)

wherein $R_1$ represents an anilino group, an acylamino group or a ureido group, $R_2$ represents an aralkyl group, an alkyl group or an alkenyl group, $X_1$, $X_2$, and $X_3$ each represents hydrogen, an alkyl group, a halogen atom, an alkoxy group, an aryloxy group, an acylamino group, a carbamoyl group, a sulfamoyl group, a sulfonyl group, or a cyano group. $X_1$, $X_2$, and $X_3$ may be the same or different.

In greater detail, $R_1$ can represent an anilino group, for example, a phenylamino group, an o-chlorophenylamino group, a 2,4-dichlorophenylamino group, a 2,4-dichloro-5-methoxyphenylamino group, a 2-chloro-5-tetradecanamidophenylamino group, a 2-chloro-5-[α-(2,4-di-t-amylphenoxy)butyramido]-phenylamino group, a 2-chloro-5-[(3-octadecenyl)succinimido]phenylamino group or a 2-chloro-5-{α-[(3-t-butyl-4-hydroxy)phenoxy]tetradecanamido}-phenylamino group, etc. Alternatively, $R_1$ can represent an acylamino group (for example, an acetylamino group, a butyramido group, an α-(3-pentadecylphenoxy)butyramido group, an n-tetradecanamido group, an α-(2,4-di-t-amylphenoxy)butyramido group, a 3-[α-(2,4-di-t-amylphenoxy)butyramido]benzamido group, a benzamido group or a 3-acetylamidobenzamido group, etc.), or a ureido group (for example, a phenylureido group, a methylureido group of a 3-[α-(2,4-di-t-amylphenoxy)butyramido]phenylureido group, etc.).

$X_1$, $X_2$, and $X_3$ each represents hydrogen, an alkyl group (for example, a methyl group or an ethyl group, etc.), a halogen atom (for example, a chlorine atom, a bromine atom or a fluorine atom), an alkoxy group (for example, a methoxy group or an ethoxy group, etc.), an aryloxy group (for example, a phenyloxy group or a naphthyloxy group, etc.), an acylamino group (for example, an acetylamino group or an α-(2,4-di-t-amylphenoxy)butyramido group, etc.), a carbamoyl group (for example, a methylcarbamoyl group or a phenylcarbamoyl group, etc.), a sulfamoyl group (for example, a methylsulfamoyl group or a phenylsulfamoyl group, etc.), a sulfonyl group (for example, an ethylsulfonyl group, a butylsulfonyl group or a methylsulfonyl group, etc.) or a cyano group.

Preferably $R_2$ represents a straight chain or branched chain alkyl group having 1 to 22 carbon atoms, which may be substituted. Examples of the straight chain alkyl group include a methyl group, an ethyl group, a propyl group, a butyl group, an octyl group, a dodecyl group, a tetradecyl group, an octadecyl group and a heptadecyl group. Examples of the branched chain alkyl group include an i-propyl group and a tert-butyl group. Further, $R_2$ may represent an aralkyl group (for example, a benzyl group or a 2-phenylethyl group, etc.) or an alkenyl group (for example, a propenyl group, etc.).

The alkyl, aralkyl and alkenyl groups represented by $R_2$ may be substituted, such as by substituents selected from a halogen atom, a nitro group, a cyano group, an aryl group, an alkoxy group, an aryloxy group, a carboxyl group, an alkylcarbonyl group, an arylcarbonyl group, an alkoxycarbonyl group, an aryloxycarbonyl group, an acyloxy group, a sulfamoyl group, a carbamoyl group, an acylamino group, a diacylamino group, a ureido group, a thioureido group, a urethane group, a thiourethane group, a sulfonamido group, a heterocyclic group, an arylsulfonyloxy group, an alkylsulfonyloxy group, an arylsulfonyl group, an alkylsulfonyl group, an arylthio group, an alkylthio group, an alkylsulfinyl group, an arylsulfinyl group, an alkylamino group, a dialkylamino group, an anilino group, an N-arylanilino group, an N-alkylanilino group, an N-acylanilino group, and a hydroxy group.

Among couplers represented by formula (I), those in which $R_2$ is an alkyl group having from 1 to 5 carbon atoms are particularly preferred because the dyes formed have good fastness.

Examples of magenta couplers which can be used in the present invention are illustrated below. These examples are representative and are not to be construed as limiting.

Coupler-1
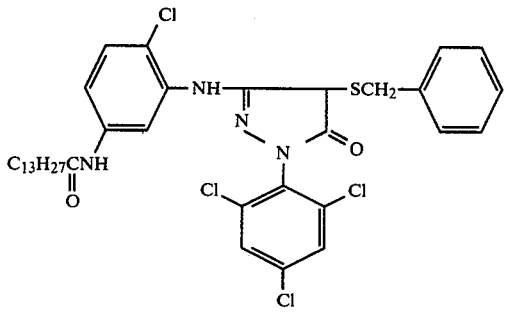
Coupler-2
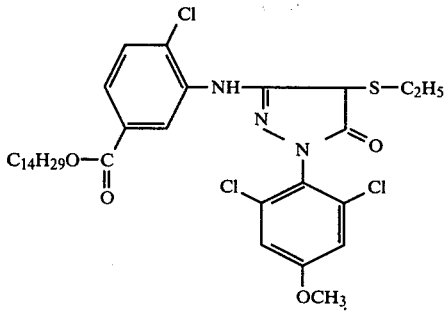
Coupler-3
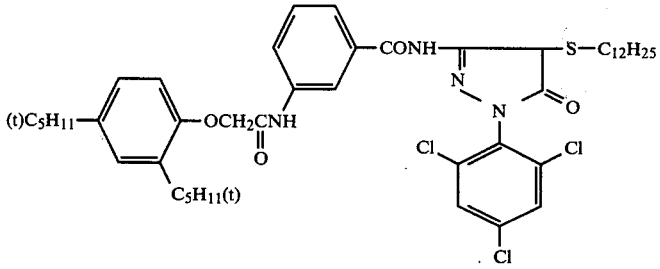
Coupler-4
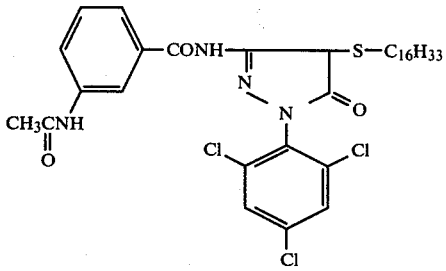
Coupler-5
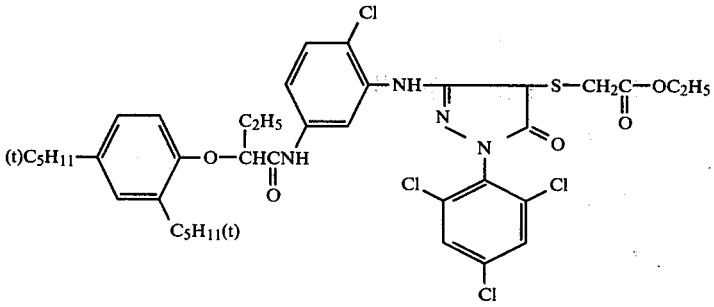

-continued
Coupler-6
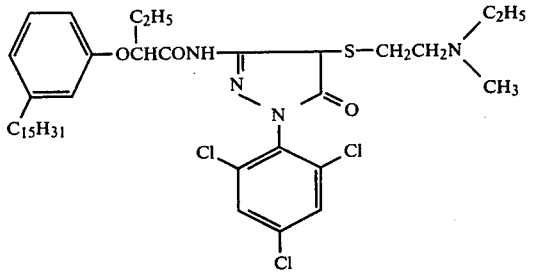
Coupler-7
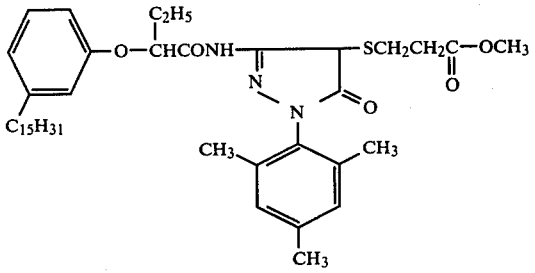
Coupler-8
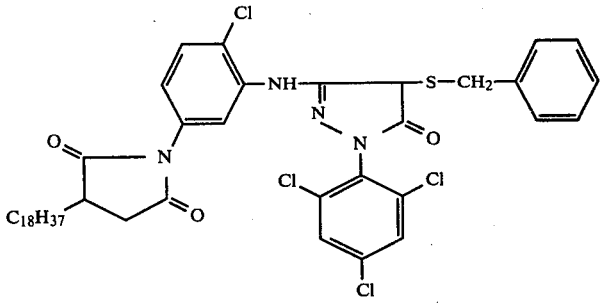
Coupler-9
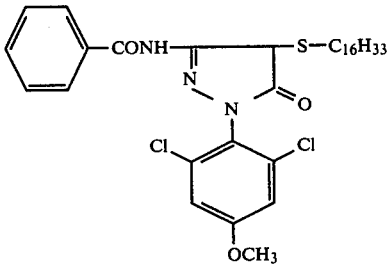
Coupler-10
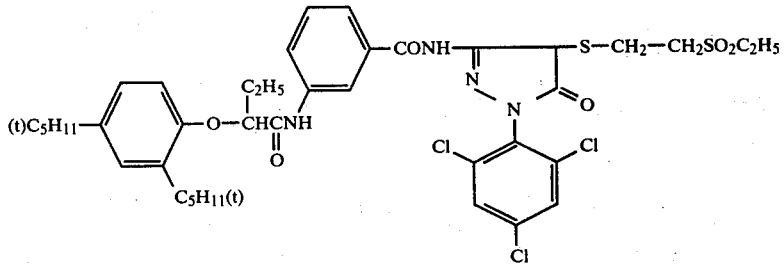

-continued
Coupler-11
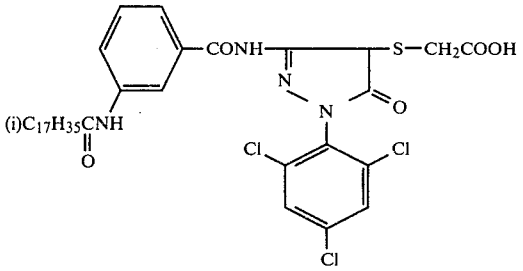
Coupler-12
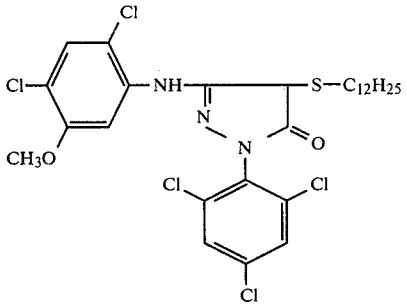
Coupler-13
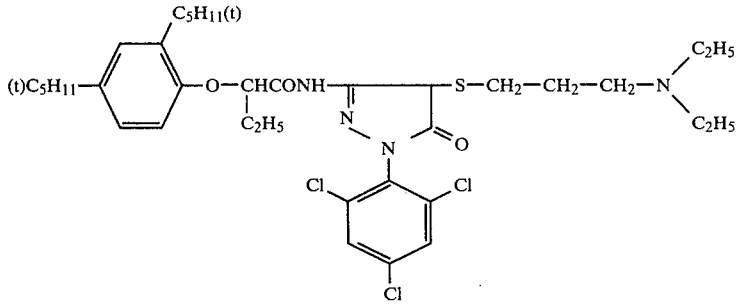
Coupler-14
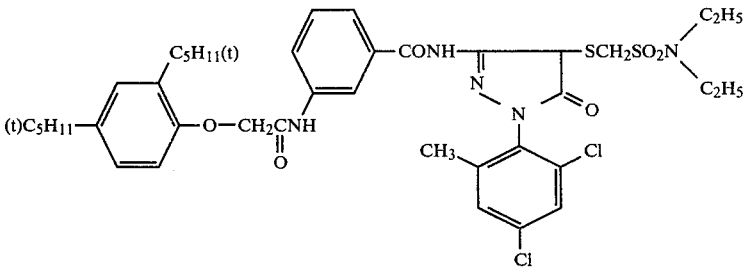
Coupler-15
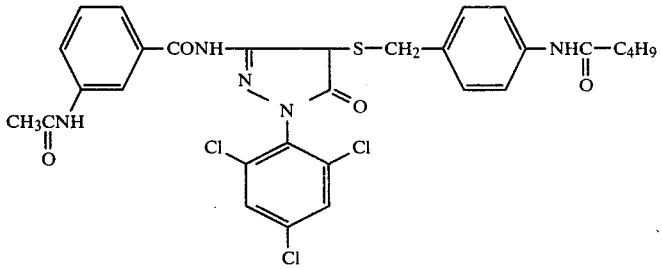

-continued
Coupler-16
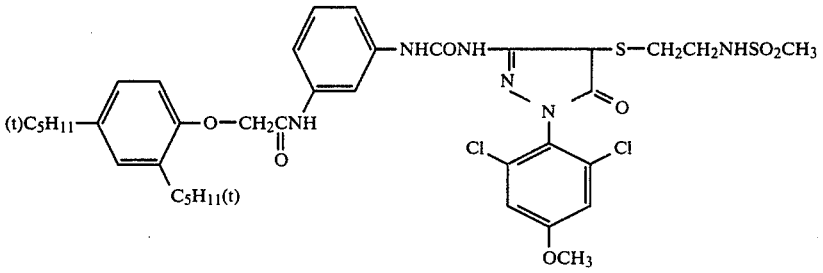
Coupler-17
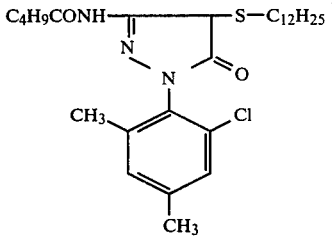
Coupler-18
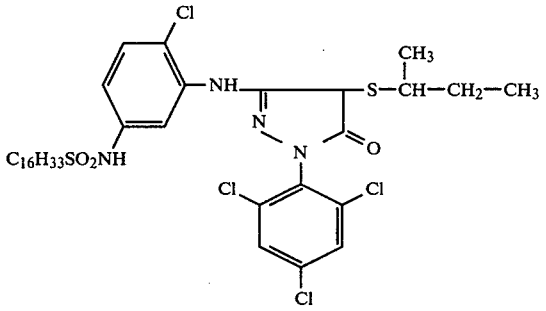
Coupler-19
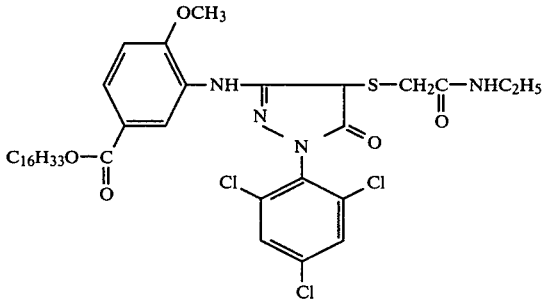
Coupler-20
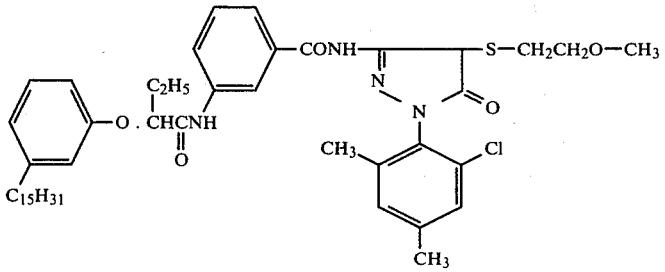

-continued
Coupler-21
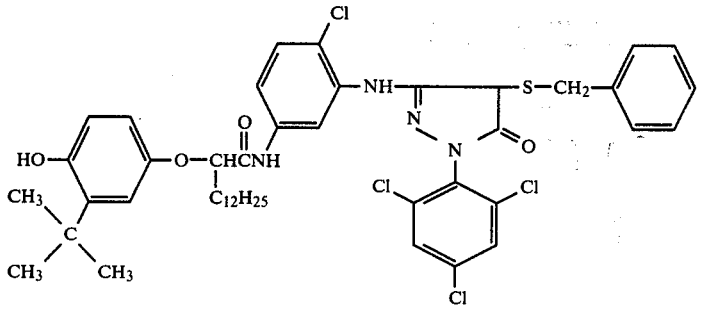
Coupler-22
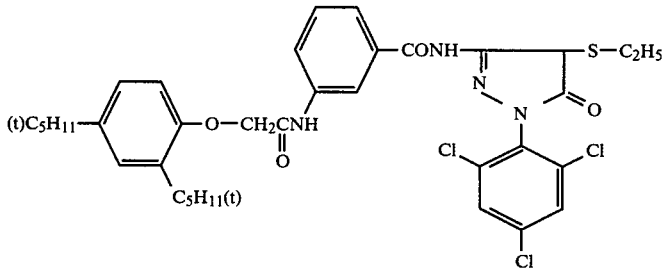
Coupler-23
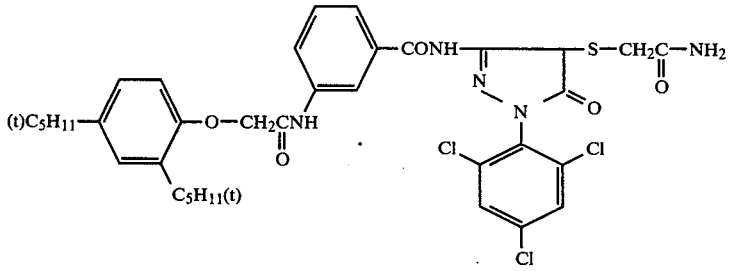
Coupler-24
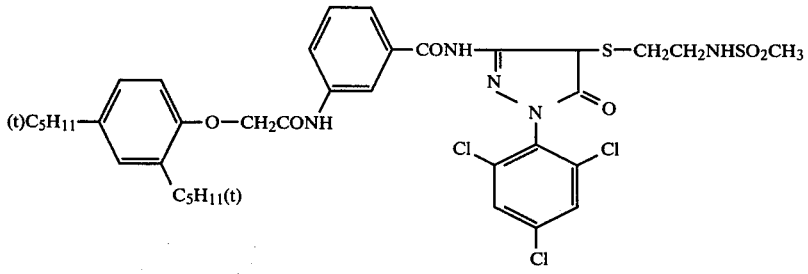
Coupler-25
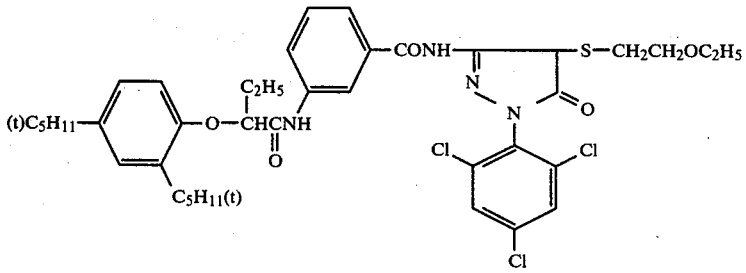

-continued
Coupler-26
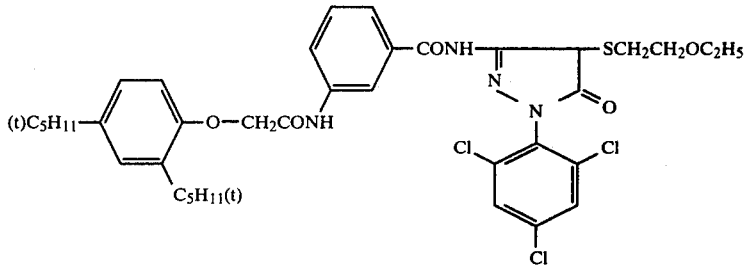
Coupler-27
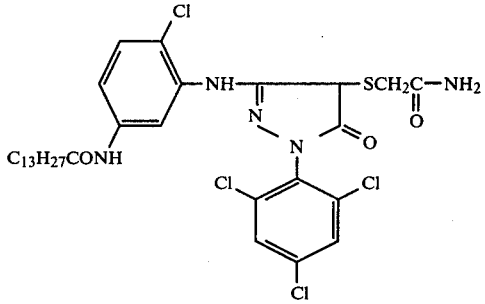
Coupler-28
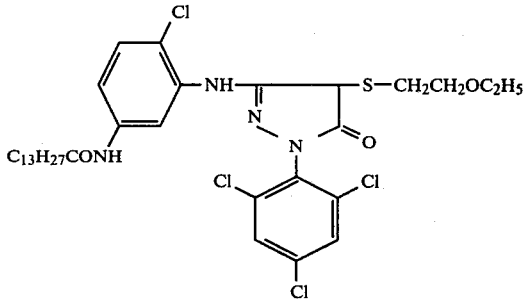
Coupler-29
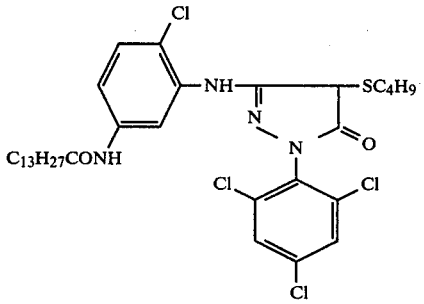
Coupler-30
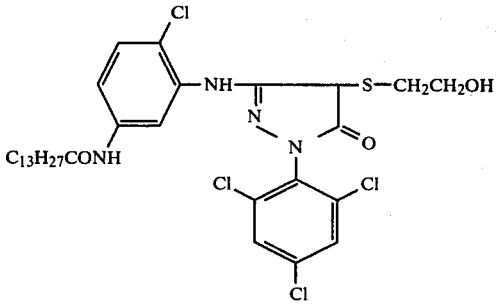

-continued

Coupler-31

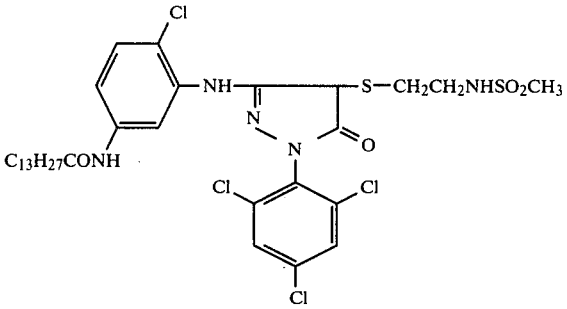

Coupler-32

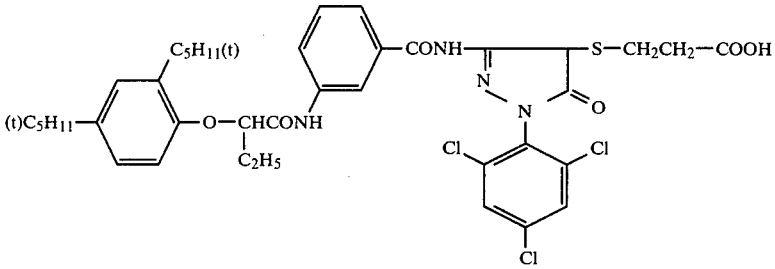

Coupler-33

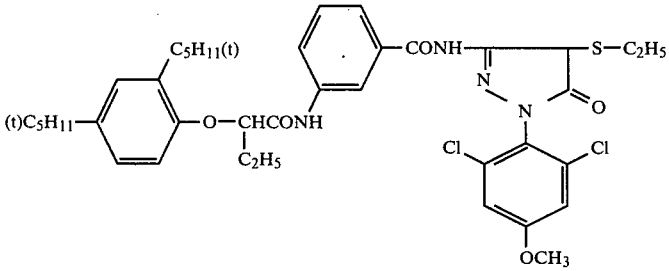

Coupler-34

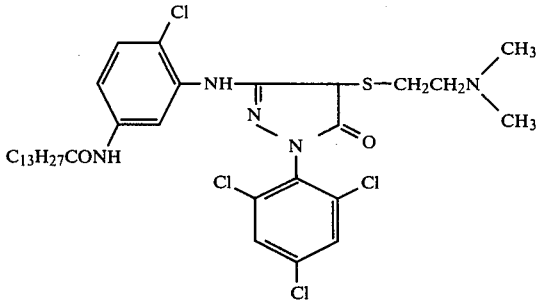

Coupler-35

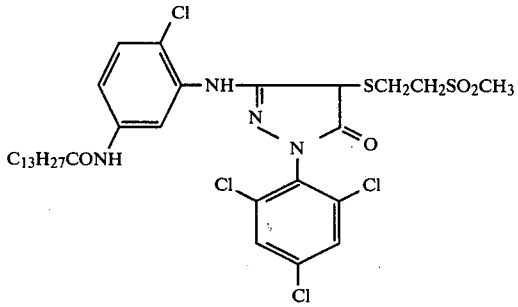

The 1-phenyl-3-pyrazolidone compounds used in the present invention can be used individually or as a mixture two or more thereof. The amount of the 1-phenyl-3-pyrazolidone derivative to be added can range from 0.005 mol to 10 mols, and preferably from 0.01 mol to 2 mols, per mol of the 2-equivalent magenta coupler of the formula (I).

The 1-phenyl-3-pyrazolidone derivatives which can be used in the present invention include compounds represented by formula (II).

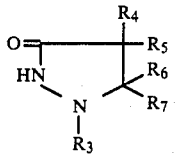

(II)

wherein $R_3$ represents an aryl group, which may be substituted. Examples of the substituents include a halogen atom, an alkyl group, an aryl group, an aralkyl group, an alkoxy group, an aryloxy group, an alkylthio group, an arylthio group, an acylamino group, a nitro group, a sulfonamino group, a cyano group, a hydroxy group, a sulfo group, a carboxy group or an alkyloxycarbonyl group. Of these substituents, an alkoxy group, an aryloxy group, an alkylthio group and an arylthio group are particularly preferred. $R_4$, $R_5$, $R_6$, and $R_7$ each represents hydrogen, an alkyl group, a substituted alkyl group (examples of the substituents including an aryl group, a hydroxy group, a halogen atom, an acyloxy group, an alkoxy group, an aryloxy group, an alkylthio group, an arylthio group, a heterocyclic group, etc.), an aryl group, a substituted aryl group (examples of the substituents including an alkyl group, an aryl group, a halogen atom, an alkoxy group, an aryloxy group, an alkylthio group, an arylthio group, an amino group, an alkylamino group, an acylamino group, a sulfonamino group, a cyano group, a nitro group, a hydroxy group, etc.), an alkoxy group, an aryloxy group or an aralkyloxy group. In the formula (II) above, when $R_4$, $R_5$, $R_6$, and $R_7$ each represents a substituent having less than 6 carbon atoms, $R_3$ represents an aryl group having a substituent having at least 6 carbon atoms, and when $R_3$ represents an aryl group having a substituent having less than 6 carbon atoms, at least one of $R_4$, $R_5$, $R_6$, and $R_7$ represents a substituent having at least 6 carbon atoms.

Specific examples of the 1-phenyl-3-pyrazolidone compounds which can be used in the present invention are illustrated below, but the present invention is not to be construed as being limited thereto.

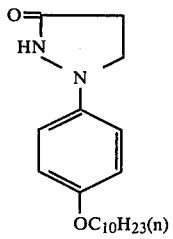

Add-1

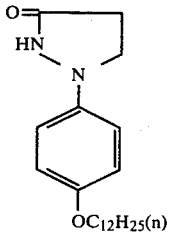

Add-2

-continued

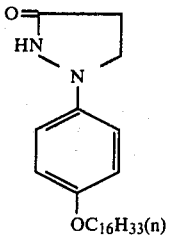

Add-3

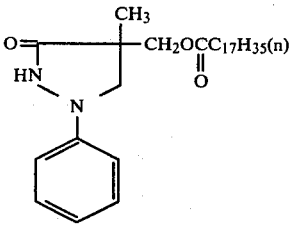

Add-4

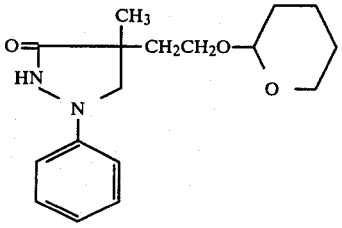

Add-5

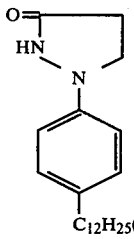

Add-6

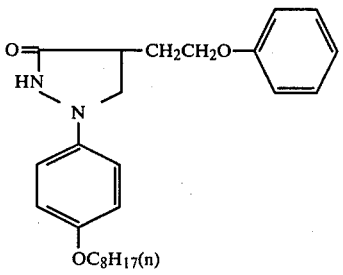

Add-7

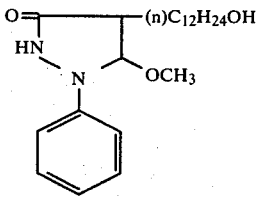

Add-8

-continued

Add-9

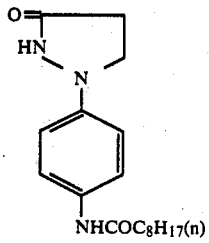

Add-10

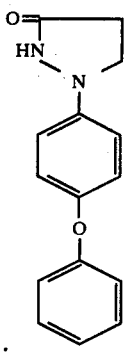

Add-11

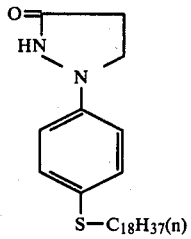

Add-12

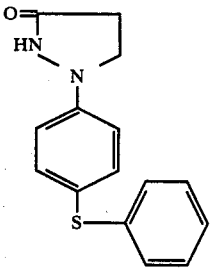

Add-13

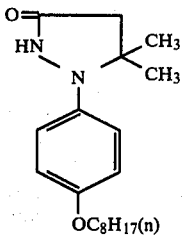

In a preferred embodiment of the present invention, a hydroquinone derivative can be added in the color photographic light-sensitive material of the present invention.

The preferred embodiment of the present invention can provide a color photographic light-sensitive material having a magenta color image-forming layer which contains a reduced amount of coated silver and provides a high color sensitivity as well as a low level of fog.

Also, the preferred embodiment of the present invention can improve the preservability of a photographic light-sensitive material containing a magenta coupler having an alkylthio coupling-off group without the increase of fog.

Further, the preferred embodiment of the present invention can improve the light-fastness and the durability of a dye formed from a magenta coupler having an alkylthio coupling-off group.

The hydroquinone derivative used in the present invention can be represented by formula (III)

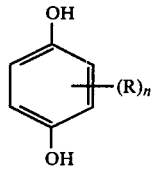

(III)

wherein R represents an alkyl group having 8 to 30 carbon atoms, an aryl group, an alkoxy group, an aryloxy group, a carbamoyl group, a sulfamoyl group, an alkoxycarbonyl group or an aryloxycarbonyl group. The alkyl group and the aryl group may be substituted with one or more substituents of a halogen atom, an alkyl group, an aryl group, an alkoxy group, an aryloxy group, a carboxyl group, an alkoxycarbonyl group, an aryloxycarbonyl group, an acyl group, an acyloxy group, a carbamoyl group, a sulfo group, a sulfamoyl group, a sulfonamido group, an N-alkylamino group, an N-arylamino group, an acylamino group, an imido group or a hydroxy group. n represents an integer of from 1 to 4, and when n represents an integer of more than 2, R may be the same or different.

Specific examples of compounds represented by formula (III) according to the present invention are illustrated below, but the present invention is not to be construed as being limited thereto.

HQ-1 2,5-Di-tert-octylhydroquinone
HQ-2 2-tert-Octyl-5-methylhydroquinone
HQ-3 2,6-Di-n-dodecylhydroquinone
HQ-4 2-n-Dodecylhydroquinone
HQ-5 2,2'-Methylenebis-5,5'-di-tert-butylhydroquinone
HQ-6 2,5-Di-n-octylhydroquinone
HQ-7 2-Dodecylcarbamoylhydroquinone
HQ-8 2-(β-n-Dodecyloxycarbonyl)ethylhydroquinone
HQ-9 2-(N,N-Dibutylcarbamoyl)hydroquinone
HQ-10 2-n-Dodecyl-5-chlorohydroquinone
HQ-11 2-(2-Octadecyl)-5-methylhydroquinone
HQ-12 2,5-Di-(p-methoxyphenyl)hydroquinone
HQ-13 2-tert-Octylhydroquinone
HQ-14 2-{β-[3-(3-Sulfobenzamido)benzamido]ethyl}-hydroquinone
HQ-15 2,5-Dichloro-3,6-diphenylhydroquinone
HQ-16 2,6-Dimethyl-3-tert-octylhydroquinone
HQ-17 2,3-Dimethyl-5-tert-octylhydroquinone
HQ-18 2-[β-(Dodecanoyloxy)ethyl]carbamoylhydroquinone
HQ-19 2-Dodecyloxycarbonylhydroquinone
HQ-20 2-[β-(4-Octanamidophenyl)ethyl]hydroquinone
HQ-21 2-Methyl-5-dodecylhydroquinone
HQ-22, 2,5-Di-tert-hexylhydroquinone The hydroquinone derivative of the formula (III) is added in at least one of the silver halide emulsion layer containing the coupler of the formula (I) and a hydrophilic colloid layer adjacent thereto.

The hydroquinone derivative of the formula (III) can be used in an amount of from 0.005 mol to 5 mols, and preferably from 0.01 mol to 1 mol, per mol of the magenta coupler of the formula (I).

The organic solvent having a high boiling point for a photographic additive used in the present invention can be any known high boiling point organic solvent having a boiling point of at least 170° C. For example, phthalic acid alkyl esters (e.g., dibutyl phthalate, dioctyl phthalate, etc.), phosphoric acid esters (e.g., diphenyl phosphate, triphenyl phosphate, tricresyl phosphate, dioctylbutyl phosphate, etc.), citric acid esters (e.g., tributyl acetylcitrate, etc.), benzoic acid esters (e.g., octyl benzoate, etc.), alkyl amides (e.g., diethyl laurylamide, etc.), fatty acid esters (e.g., dibutoxyethyl succinate, dioctyl azelate, etc.), trimesinic acid esters (e.g., tributyl trimesinate, etc.), etc., as described in U.S. Pat. No. 2,322,027 are preferred. Also those described in U.S. Pat. Nos. 2,322,027, 2,533,514, and 2,835,579, Japanese Patent Publication No. 63233/71, U.S. Pat. No. 3,287,134, British Pat. No. 958,441, Japanese Patent Application (OPI) No. 1031/72 (The term "OPI" as used herein refers to a "published unexamined Japanese patent application"), British Pat. No. 1,222,753, U.S. Pat. No. 3,936,303, Japanese Patent Application (OPI) Nos. 26037/76 and 82078/77, U.S. Pat. Nos. 2,353,262, 2,852,383, 3,554,755, 3,676,137, 3,676,142, 3,700,454, 3,748,141 and 3,837,863, German Patent Application (OLS) No. 2,538,889, Japanese Patent Application (OPI) Nos. 27921/76, 27922/76, 26035/76, 26036/76 and 62632/75, Japanese Patent Publication No. 29461/74, U.S. Pat. Nos. 3,936,303 and 3,748,141, Japanese Patent Application (OPI) No. 1521/78, etc., are preferred.

In order to incorporate the coupler and the 1-phenyl-3-pyrazolidone derivative into a hydrophilic colloid layer, the method described in U.S. Pat. No. 2,322,027 using an organic solvent having a high boiling point as described above can be employed. An organic solvent having a low boiling point of about 30° to 150° C. may be used as an auxiliary solvent. That is, the compounds can be dissolved in an organic solvent having a low boiling point of about 30° to 150° C. such as a lower alkyl acetate (e.g., ethyl acetate, butyl acetate, etc.), ethyl propionate, sec-butyl alcohol, methyl isobutyl ketone, β-ethoxyethyl acetate, methyl Cellosolve acetate and then the solution is dissolved in the above-described organic solvents having a high boiling point and the resulting solution is dispersed in a hydrophilic colloid.

Furthermore, the dispersion method using a polymeric material as described in Japanese Patent Publication No. 39853/76, Japanese Patent Application (OPI) No. 59943/76 can also be used.

When couplers have an acid group such as a carboxylic acid group, a sulfonic acid group, etc., they can be incorporated in a hydrophilic colloid as an alkaline aqueous solution thereof.

The photographic emulsion used in this invention can be prepared using the methods described in, e.g., P. Glafkides, *Chimie et Physique Photographique,* Paul Montel, Paris (1967), G. F. Duffin, *Photographic Emulsion Chemistry,* The Focal Press, London (1966), V. L. Zelikman et al., *Making and Coating Photographic Emulsions,* The Focal Press, London (1964), etc. That is, any of the acid method, the neutral method, the ammonia method and other methods can be used. Moreover, a soluble silver salt can be reacted with a soluble halide salt using any of the single jet method, the double jet method or a combination thereof.

The method in which grains are formed in the presence of an excess of silver ions (the so-called reverse mixing method) can also be used. As one of the modes of the double jet method, the method in which the pAg of the liquid phase in which the silver halide is to be produced is kept constant, that is, the so-called controlled double jet method, can be used. This method can provide silver halide emulsions having a regular crystal form and an almost uniform grain size.

Two or more silver halide emulsions which are separately prepared can be mixed and then used, if desired.

In the process of the formation of the silver halide grains or physical ripening thereof, cadmium salts, zinc salts, lead salts, thallium salts, iridium salts or complex salts thereof, rhodium salts or complex salts thereof, iron salts or iron complex salts, and the like can be present.

The photographic emulsion of the present invention can also be spectrally sensitized with methine dyes or other known sensitizing dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes such as basic heterocyclic nuclei is applicable to these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., can be used. The carbon atoms of these nuclei can also bear substituents.

Merocyanine dyes or complex merocyanine dyes containing 5- or 6-membered heterocyclic nuclei such as a pyrazolin-5-one nucleus, a thiohydantoin nucleus, a 2-thioxazolidin-2,4-dione nucleus, a thiazolidin-2,4-dione nucleus, a rhodanine nucleus, a thiobarbituric acid nucleus, etc., as nuclei having a ketomethylene structure, can be employed.

Useful sensitizing dyes are those described in German Pat. No. 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Pat. No. 1,242,588, Japanese Patent Publication Nos. 14030/69 and 24844/77, etc.

These sensitizing dyes can be employed individually, and can also be employed in combination. A combination of sensitizing dyes can often be used particularly for the purpose of supersensitization. Representative examples of such combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Pat. Nos. 1,344,281 and 1,507,803, Japaense Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic ring group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, and the like, can be present. The combinations described in U.S. Pat. Nos. 3,615,613, 3,615,641, 3,617,295 and 3,635,721 are particularly useful.

For the purposes of increasing sensitivity, increasing contrast or accelerating development, the photographic emulsion layer of the photographic light-sensitive element according to the present invention can contain other additives, for example, polyalkylene oxides or derivatives thereof such as ethers, esters, amines, etc., thioether compounds, thiomorpholine compounds, quaternary ammonium compounds, urethane derivatives, urea derivatives, imidazole derivatives, 3-pyrazolidones, etc. For example, the compounds as described in U.S. Pat. Nos. 2,400,532, 2,423,549, 2,716,062, 3,617,280, 3,772,021, 3,808,003, British Pat. No. 1,488,991, etc.

Gelatin can be advantageously used as the binder or protective colloid for the photographic emulsion used in this invention. However, other hydrophilic colloids can be used as well. For example, proteins such as gelatin derivatives, graft polymers between gelatin and other high polymers, albumin, casein, etc.; cellulose derivatives such as hydroxyethyl cellulose, carboxymethyl cellulose, cellulose sulfates, etc.; saccharide derivatives such as sodium alginate, starch derivatives, etc.; and various synthetic hydrophilic high polymers of homo- or copolymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc., can be used as the binder or protective colloid for the photographic emulsion.

Acid-processed gelatin and enzyme-processed gelatin as described in *Bull. Soc. Sci. Photo. Japan,* No. 16, p. 30 (1966) can be used as well as lime-processed gelatin as the gelatin. In addition, the hydrolyzed products of gelatin and enzyme-decomposed products of gelatin are also suitable. Suitable gelatin derivatives which can be used include those obtained by reacting gelatin with various compounds such as acid halides, acid anhydrides, isocyanates, bromoacetic acid, alkanesultones, vinylsulfonamides, maleinimides, polyalkylene oxides, epoxy compounds, etc. Specific examples thereof are described in U.S. Pat. Nos. 2,614,928, 3,132,945, 3,186,846, 3,312,553, British Pat. Nos. 861,414, 1,033,189, 1,005,784, Japanese Patent Publication No. 26845/67.

As the above-described gelatin graft polymer, those which are obtained by grafting homo- or copolymers of vinyl monomers such as acrylic acid, methacrylic acid, the ester or amide derivatives thereof, acrylonitrile, styrene, etc., to gelatin can be used. In particular, graft polymers with a polymer having some compatibility with gelatin, such as polymers of acrylic acid, methacrylic acid, acrylamide, methacrylamide, hydroxyalkyl, methacrylates, etc., are preferred. Examples thereof are described in U.S. Pat. Nos. 2,763,625, 2,831,767, 2,956,884, etc. Typical synthetic hydrophilic materials are described in, e.g., West German Patent Application (OLS) No. 2,312,708, U.S. Pat. Nos. 3,620,751, 3,879,205 and Japanese Patent Publication No. 7561/68.

The present invention is also applicable to multilayer multicolor photographic materials containing layers sensitive to at least two different spectral wavelength ranges on a support. A multilayer color photographic material generally possesses at least one red-sensitive silver halide emulsion layer, at least one green-sensitive silver halide emulsion layer, and at least one blue-sensitive silver halide emulsion layer, respectively, on a support. The order of these layers can be varied optionally as desired. Ordinarily, a cyan-forming coupler is present in a red-sensitive emulsion layer, a magenta-forming coupler is present in a green-sensitive emulsion layer and a yellow-forming coupler is present in a blue-sensitive emulsion layer, respectively. However, if necessary, a different combination can be employed.

The hydrophilic colloid layers of the light-sensitive material prepared using the present invention can contain water-soluble dyes such as filter dyes or for various purposes of preventing irradiation or other purposes. Such dyes include oxonol dyes, hemioxonol dyes, styryl dyes, merocyanine dyes, cyanine dyes and azo dyes. Of these dyes, oxonol dyes, hemioxonol dyes and merocyanine dyes are useful. Specific examples of dyes which can be employed are described in British Pat. Nos. 584,609 and 1,177,429, Japanese Patent Application (OPI) Nos. 85130/73, 99620/74, 114420/74 and 108115/77, U.S. Pat. Nos. 2,274,782, 2,533,472, 2,956,879, 3,148,187, 3,177,078, 3,247,127, 3,540,887, 3,575,704, 3,653,905, 3,718,472, 4,071,312 and 4,070,352.

In the practice of the present invention, known color fading preventing agents are described below can be employed. The color image stabilizer used in the present invention can be used individually or in a combination of two or more thereof. Specific examples of known color fading preventing agents include, for example, hydroquinone derivatives as described in U.S. Pat. Nos. 2,360,290, 2,418,613, 2,675,314, 2,701,197, 2,704,713, 2,728,659, 2,732,300, 2,735,765, 2,710,801 and 2,816,028, British Pat. Nos. 1,363,921; gallic acid derivatives as described in U.S. Pat. Nos. 3,457,079 and 3,069,262; p-alkoxyphenols as described in U.S. Pat. Nos. 2,735,765 and 3,698,909, Japanese Patent Publication Nos. 20977/74 and 6623/77; p-oxyphenol derivatives as described in U.S. Pat. Nos. 3,432,300, 3,573,050, 3,574,627 and 3,764,337, Japanese Patent Application (OPI) Nos. 35633/77, 147434/77 and 152225/77; bisphenol derivatives as described in U.S. Pat. No. 3,700,455, etc.

The light-sensitive material prepared according to the present invention can also contain, as color fog preventing agents, hydroquinone derivatives, aminophenol derivatives, gallic acid derivatives, ascorbic acid derivatives, or the like. Specific examples of these agents are described in U.S. Pat. Nos. 2,360,290, 2,336,327, 2,403,721, 2,418,613, 2,675,314, 2,701,197, 2,704,713, 2,728,659, 2,732,300 and 2,735,765, Japanese Patent Application (OPI) Nos. 92988/75, 92989/75, 93928/75 and 110337/75 and 146235/77, Japanese Patent Publication No. 23813/75, etc.

The hydrophilic colloid layers of the light-sensitive material prepared in accordance with the present invention can also contain UV absorbents. For example, benzotriazole compounds substituted with aryl groups (e.g., those described in U.S. Pat. No. 3,533,794), 4-thiazolidone compounds (e.g., those described in U.S. Pat. Nos. 3,314,794 and 3,352,681), benzophenone compounds (e.g., those described in Japanese Patent Application (OPI) No. 2784/71), cinnamic acid ester compounds (e.g., those described in U.S. Pat. Nos. 3,707,375 and 3,705,805), butadiene compounds (e.g., those described in U.S. Pat. No. 4,045,229) or benzoxazole compounds (e.g., those described in U.S. Pat. No. 3,700,455) can be employed. Further, the compounds as described in U.S. Pat. No. 3,499,762, Japanese Patent Application (OPI) No. 48535/79 can also be used. U.V. absorbing couplers (e.g., α-naphthol type cyan color-forming couplers) or U.V. absorbing polymers can also be employed. These U.V. absorbents can also be mordanted in a specific layer(s), if desired.

The photographic emulsion layers and other hydrophilic colloid layers of the light-sensitive material prepared in accordance with the present invention can contain whitening agents such as stilbenes, triazines, oxazoles, or coumarins, etc. These agents can be water-soluble or can also be employed as a dispersion of water-insoluble whitening agents. Specific examples of fluorescent whitening agents are described in U.S. Pat. Nos. 2,632,701, 3,269,840 and 3,359,102, British Pat. Nos. 852,075 and 1,319,763, etc.

In the present invention, known couplers other than the pyrazolone couplers of the formula (I) can be employed together with the pyrazolone couplers of the formula (I).

As yellow color forming couplers, benzoyl acetanilide type and pivaloyl acetanilide type compounds are advantageous. Specific examples of yellow color-forming couplers which can be employed are described, for example, in U.S. Pat. Nos. 2,875,057, 3,265,506, 3,408,194, 3,551,155, 3,582,322, 3,725,072 and 3,891,445, German Pat. No. 1,547,868, German Patent Application (OLS) Nos. 2,219,917, 2,261,361 and 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77 and 115219/77, etc.

Other pyrazoline type compounds, indazolone type compounds, cyanoacetyl compounds, etc., can be employed as magenta color-forming couplers and particularly preferred couplers are pyrazolone type compounds. Specific examples of magenta color-forming couplers which can be employed are those described, for example, in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, German Pat. No. 1,810,464, German Patent Application (OLS) Nos. 2,408,665, 2,417,945, 2,418,959 and 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76, and 55122/78, etc.

Phenol type compounds, naphthol type compounds, etc., can be employed as cyan color-forming couplers. Specific examples of cyan color-forming couplers which can be employed are those described, for example, in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, German Patent Application (OLS) Nos. 2,414,830 and 2,454,329, Japanese Patent Application (OPI) Nos. 59838/73, 26034/76, 5055/73, 146828/76, 69624/77 and 90932/77, etc.

Colored couplers which can be employed are those described, for example, in U.S. Pat. Nos. 3,476,560, 2,521,908 and 3,034,892, Japanese Patent Publication Nos. 2016/69, 22335/63, 11304/67 and 32461/69, Japanese Patent Application (OPI) Nos. 26034/76 and 42121/77, German Patent Application (OLS) No. 2,418,959, etc.

DIR couplers which can be employed are those described, for example, in U.S. Pat. Nos. 3,227,554, 3,617,291, 3,701,783, 3,790,384 and 3,632,345, German Patent Application (OLS) Nos. 2,414,006, 2,454,301 and 2,454,329, British Pat. No. 953,454, Japanese Patent Application (OPI) Nos. 69624/77, 122335/74, Japanese Patent Publication No. 16141/76, etc.

In addition to DIR couplers, compounds which release development inhibitors upon development can also be present in the light-sensitive material. For example, those DIR compounds as described, for example, in U.S. Pat. Nos. 3,297,445 and 3,379,529, German Patent Application (OLS) No. 2,417,914, Japanese Patent Application (OPI) Nos. 15271/77 and 9116/78, etc., can be employed.

Two or more kinds of the couplers described above can be incorporated in the same layer or the same coupler compound can also be present in two or more layers.

These couplers including the magenta coupler of the formula (I) are incorporated into the emulsion layers, generally in a total amount of from about $2\times10^{-3}$ mol to about $5\times10^{-1}$ mol, and preferably from $1\times10^{-2}$ mol to $5\times10^{-1}$ mol, per mol of silver.

Any known method can be used for processing the light-sensitive material according to the present invention. Known processing solutions can be used. The processing temperature can be from about 18° C. to 50° C., in general, but temperatures lower than about 18° C. or higher than about 50° C. may be used, if desired.

A color developer generally comprises an alkaline aqueous solution containing a color developing agent. Suitable color developing agents which can be employed include known primary aromatic amine developing agents, e.g., phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfamidoethylaniline, 4-amino-3-methyl-N-ethyl-N-β-methoxyethylaniline, etc.).

In addition, those developing agents described in L.F.A. Mason, *Photographic Processing Chemistry*, pp. 226–229, Focal Press (1966), U.S. Pat. Nos. 2,193,015 and 2,592,364, Japanese Patent Application (OPI) No. 64933/73, etc., can be employed.

The color developers can also contain pH buffering agents such as sulfites, carbonates, borates and phosphates of alkali metals, developing inhibitors or anti-fogging agents such as bromide, iodides or organic anti-fogging agents, etc. In addition, if desired, the color developers can also contain water softeners, preservatives such as hydroxylamine; organic solvents such as benzyl alcohol, diethylene glycol, etc.; developing accelerators such as polyethylene glycol, quaternary ammonium salts, amines; dye forming couplers; competing couplers; fogging agents such as sodium borohydride; auxiliary developers such as 1-phenyl-3-pyrazolidone; viscosity-imparting agents; polycarboxylic acid type chelating agents described in U.S. Pat. No. 4,083,723; anti-oxidizing agents as described in German Patent Application (OLS) No. 2,622,950; and the like.

The photographic emulsion layers after color development are generally bleach-processed. Bleach processing can be performed at the same time as fixing or separately therefrom. Suitable bleaching agents which can be employed are compounds of polyvalent metals such as iron (III), cobalt (III), chromium (VI), copper (II), etc., peracids, quinones, nitroso compounds, etc. Specific examples include ferricyanides; bichromates; organic complexes of iron (III) or cobalt (III); aminopolycarboxylic acids such as ethylenediaminetetraacetic acid, nitrilotriacetic acid, 1,3-diamino-2-propanol tetraacetic acid, etc.; complexes of organic acids such as citric acid, tartaric acid, malic acid, etc.; persulfates; permanganates; nitrosophenol; etc. Of these, particularly useful bleaching agents are potassium ferricyanide, sodium ethylenediaminetetraacetate iron (III) and ammonium ethylenediaminetetraacetate iron (III). Ethylenediaminetetraacetate iron (III) complex is useful both in a bleaching solution and in a mono bath bleach-fixing solution.

Bleaching and bleach-fixing solutions can contain various additives including bleach accelerating agents as described in U.S. Pat. Nos. 3,042,520 and 3,241,966, Japanese Patent Publication Nos. 8506/70 and 8836/70, thioether compounds as described in Japanese Patent Application (OPI) No. 65732/78, and the like.

The light-sensitive material prepared using the present invention may be subjected to processing with a developing solution which is replenished or maintained its property by the methods as described in Japanese Patent Application (OPI) Nos. 84636/76, 119934/77, 46732/78, 9626/79, 19741/79 and 37731/79, Japanese Patent Application Nos. 76158/79 (corresponding to U.S. Ser. No. 159,567, filed on June 16, 1980) and 76159/79 (corresponding to U.S. Ser. No. 159,565, filed on June 16, 1980).

The light-sensitive material prepared using the present invention may be processed with a bleach-fixing solution which is subjected to regeneration treatment by the methods as described in Japanese Patent Application (OPI) Nos. 781/71, 49437/73, 18191/73, 145231/75, 18541/76, 19535/76 and 144620/76, Japanese Patent Publication No. 23178/76, etc.

The present invention is explained in greater detail with reference to the Examples below.

EXAMPLE 1

On a transparent cellulose triacetate film support, a coating composition having a composition described below was coated and then on this layer a gelatin protective layer (1 g/m$^2$) was coated to prepare Samples A to M.

Coating Composition

Green-sensitive silver iodobromide emulsion (silver iodide: 6 mol%, silver bromide: 94 mol%)
Coated amount of silver: 1 g/m$^2$
Magenta Coupler
Coated amount: $7\times10^{-4}$ mol/m$^2$
Additive according to the present invention (refer to Table 1 below)
Coated amount: $7\times10^{-5}$ mol/m$^2$
Solvent for dispersing Coupler: Tricresyl phosphate

TABLE 1

| Sample | Magenta Coupler | Additive |
|---|---|---|
| A | Coupler-1 | Add-3 |
| B | Coupler-3 | Add-2 |
| C | Coupler-3 | Add-3 |
| D | Coupler-12 | Add-3 |
| E | Coupler-12 | Add-7 |
| F | Coupler-12 | Comparison Additive |
| G | Comparison Coupler-1 | Add-3 |
| H | Comparison Coupler-2 | Add-3 |
| I | Comparison Coupler-2 | Comparison Additive |
| J | Comparison Coupler-3 | Add-3 |
| K | Comparison Coupler-4 | Add-3 |
| L | Comparison Coupler-5 | Add-3 |
| M | Comparison Coupler-6 | Add-3 |

Comparison Coupler-1

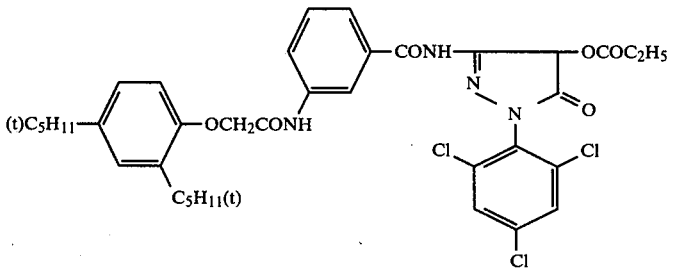

Comparison Coupler-2

TABLE 1-continued
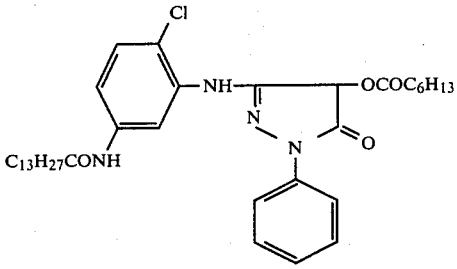
Comparison Coupler-3
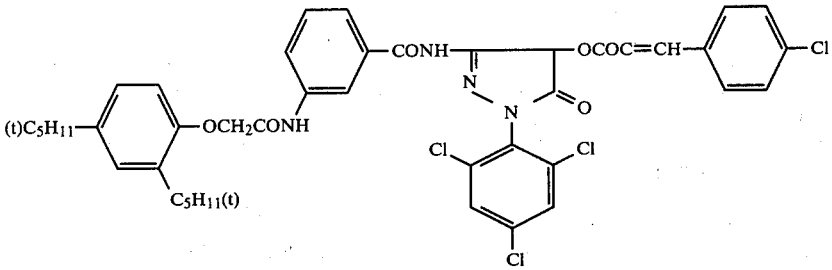
Comparison Coupler-4
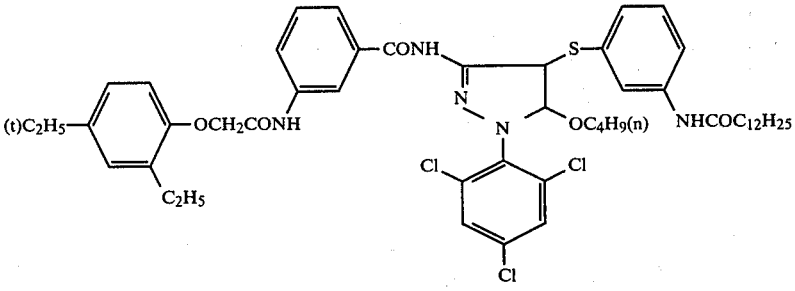
Comparison Coupler-5
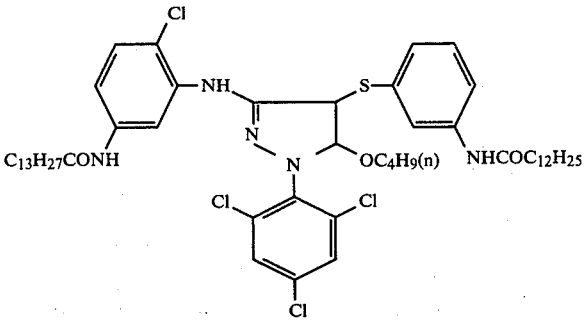
Comparison Coupler-6
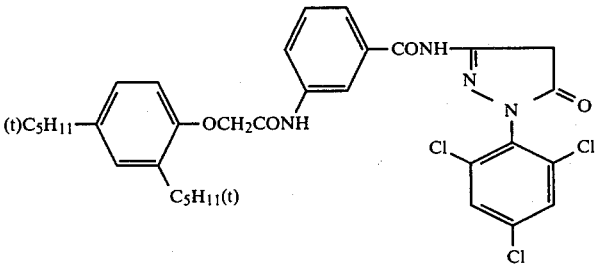
Comparison Additive TABLE 1-continued

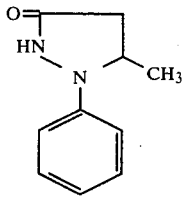

In addition to the above-described samples, 13 samples same as described above except for eliminating the additives according to the present invention and the comparison additive from the coating compositions were prepared. These samples are designated Sam-les A' to M' with corresponds to Samples A to M, respectively.

The samples were exposed through an optical wedge and then subjected to the following processing steps.

| | Processing Step | Temperature (°C.) | Time |
|---|---|---|---|
| 1. | Color development | 38 | 3 min 15 sec |
| 2. | Bleaching | " | 6 min 30 sec |
| 3. | Washing with water | " | 2 min |
| 4. | Fixing | " | 4 min |
| 5. | Washing with water | " | 4 min |
| 6. | Stabilizing bath | " | 1 min |

The processing solutions used had the following compositions.

| Color Developer Solution | |
|---|---|
| 4-Amino-N-ethyl-N-(β-methanesulfonamido-ethyl)aniline Monosulfate | 5 g |
| Sodium Sulfite | 5 g |
| Hydroxylamine Sulfate | 2 g |
| Potassium Carbonate | 30 g |
| Potassium Hydrogen Carbonate | 1.2 g |
| Potassium Bromide | 1.2 g |
| Sodium Chloride | 0.2 g |
| Trisodium Nitrilotriacetate | 1.2 g |
| Water to make | 1 l |
| | (pH 10.1) |

| Bleaching Solution | |
|---|---|
| Iron (III) Ammonium Ethylenediamine-tetraacetate | 100 g |
| Disodium Ethylenediaminetetraacetate | 10 g |
| Potassium Bromide | 150 g |
| Glacial Acetic Acid | 10 g |
| Aqueous Ammonia to adjust pH to 6.0 | |
| Water to make | 1 l |

| Fixing Solution | |
|---|---|
| Ammonium Thiosulfate | 150 g |
| Sodium Sulfite | 10 g |
| Sodium Hydrogen Sulfite | 2.5 g |
| Water to make | 1 l |
| | (pH 6.0) |

| Stabilizing Bath | |
|---|---|
| Formalin (37%) | 5 ml |

-continued

| Stabilizing Bath | |
|---|---|
| Fuji Drywell | 3 ml |
| Water to make | 1 l |

After the above-described processing, optical densities of these samples were measured using green light. The results obtained are shown in Table 2 below. In Table 2, the ratio of sensitivity is based on the ASA sensitivity indication method.

TABLE 2

| | Ratio of Sensitivity |
|---|---|
| Sample A/Sample A' | 1.35 |
| B/B' | 1.41 |
| C/C' | 1.45 |
| D/D' | 1.51 |
| E/E' | 1.51 |
| F/F' | 1.00 |
| G/G' | 1.05 |
| H/H' | 1.05 |
| I/I' | 1.00 |
| J/J' | 1.05 |
| K/K' | 1.05 |
| L/L' | 1.05 |
| M/M' | 1.07 |

From the results shown in Table 2 above, it is apparent that the additives according to the present invention have unexpected sensitizing effects to the alkylthio coupling-off type couplers.

EXAMPLE 2

Samples as described in Example 1 containing the coupler and the additives, except using a silver iodobromide emulsion containing 3 mol% of iodide (containing 100 g of silver halide and 70 g of gelatin per 1 kg of emulsion) in place of the silver halide emulsion used in Example 1, were prepared and subjected to reversal processing as described below. As in Example 1, the sensitizing effects of the additives according to the present invention are particularly markedly observed with respect to the thio coupling-off type 2-equivalent magenta couplers according to the present invention.

| | Processing Step | Temperature (°C.) | Time (minutes) |
|---|---|---|---|
| 1. | First development | 38 | 3 |
| 2. | Washing with water | " | 1 |
| 3. | Reversal | " | 2 |
| 4. | Color development | " | 6 |
| 5. | Stopping | " | 2 |
| 6. | Bleaching | " | 6 |
| 7. | Fixing | " | 4 |
| 8. | Washing with water | " | 4 |
| 9. | Stabilizing | " | 1 |
| 10. | Drying | | |

Each of the processing solutions used had the following compositions.

| First Developer Solution | |
|---|---|
| Water | 800 ml |
| Sodium Tetrapolyphosphate | 2.0 g |
| Sodium Hydrogen Sulfite | 8.0 g |
| Sodium Sulfite | 37.0 g |
| 1-Phenyl-3-pyrazolidone | 0.35 g |
| Hydroquinone | 5.5 g |
| Sodium Carbonate Monohydrate | 28.0 g |
| Potassium Bromide | 1.5 g |
| Potassium Iodide | 13.0 mg |
| Sodium Thiocyanate | 1.4 g |
| Water to make | 1 l |

| Reversal Solution | |
|---|---|
| Water | 800 ml |
| Hexasodium Nitrilo-N,N,N-trimethylene Phosphonic Acid | 3.0 g |
| Stannous Chloride Dihydrate | 1.0 g |
| Sodium Hydroxide | 8.0 g |
| Glacial Acetic Acid | 15.0 ml |
| Water to make | 1 l |

| Color Developer Solution | |
|---|---|
| Water | 800 ml |
| Sodium Tetrapolyphosphate | 2.0 g |
| Benzyl Alcohol | 5.0 ml |
| Sodium Sulfite | 7.5 g |
| Trisodium Phosphate (12 hydrate) | 36.0 g |
| Potassium Bromide | 1.0 g |
| Potassium Iodide | 90.0 mg |
| Sodium Hydroxide | 3.0 g |
| Citrazinic Acid | 1.5 g |
| 4-Amino-3-methyl-N-ethyl-N-(β-hydroxyethyl)aniline Sesquisulfate Monohydrate | 11.0 g |
| Ethylenediamine | 3.0 g |
| Water to make | 1.0 l |

| Stopping Solution | |
|---|---|
| Water | 800 ml |
| Glacial Acetic Acid | 5.0 ml |
| Sodium Hydroxide | 3.0 g |
| Dimethylaminoethaneisothiourea Dihydrochloride | 1.0 g |
| Water to make | 1 l |

| Bleaching Solution | |
|---|---|
| Water | 800 ml |
| Sodium Ethylenediaminetetraacetate Dihydrate | 2.0 g |
| Ammonium Iron (III) Ethylenediaminetetraacetate Dihydrate | 120.0 g |
| Potassium Bromide | 100.0 g |

-continued

| Bleaching Solution | |
|---|---|
| Water to make | 1 l |

| Fixing Solution | |
|---|---|
| Water | 800 ml |
| Ammonium Thiosulfate | 80.0 g |
| Sodium Sulfite | 5.0 g |
| Sodium Hydrogen Sulfite | 5.0 g |
| Water to make | 1 l |

| Stabilizing Bath | |
|---|---|
| Water | 800 ml |
| Formalin (37%) | 5.0 ml |
| Fuji Drywell | 5.0 ml |
| Water to make | 1.0 l |

EXAMPLE 3

On a transparent cellulose triacetate film support, a coating composition having a composition described below was coated and then on this layer a gelatin protective layer (1 g/m$^2$) was coated to prepare Samples N to T.

Coating Composition

Green-sensitive silver iodobromide emulsion (silver iodide: 6 mol%, silver bromide: 94 mol%)
Coated amount of silver: 1 g/m$^2$
Magenta coupler
Coated amount: $7\times10^{-4}$ mol/m$^2$
Additive according to the present invention (refer to Table 3 below)
Coated amount: $7\times10^{-5}$ mol/m$^2$
Solvent for dispersing coupler: Tricresyl phosphate

TABLE 3

| Sample | Magenta Coupler | Additive |
|---|---|---|
| N | Coupler-1 | Add-3 |
| O | Coupler-3 | Add-3 |
| P | Coupler-12 | Add-3 |
| Q | Coupler-12 | Add-7 |
| R | Comparison Coupler-1 | Add-3 |
| S | Comparison Coupler-4 | Add-3 |
| T | Comparison Coupler-5 | Add-3 |

In addition to the above-described samples, samples same as described above except for eliminating the additives according to the present invention from the coating compositions were prepared. These samples are designated Samples N' to T' which corresponds to Samples N to T, respectively.

Furthermore, samples identical to Samples N to T, except using as a fog preventing agent HQ-1 in an amount of 1/5 mol% of the magenta coupler, were prepared. These samples are designated Samples N'' to G'', respectively.

Comparison Coupler-1

-continued

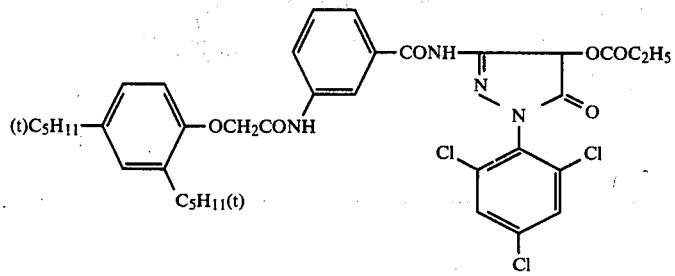

Comparison Coupler-4

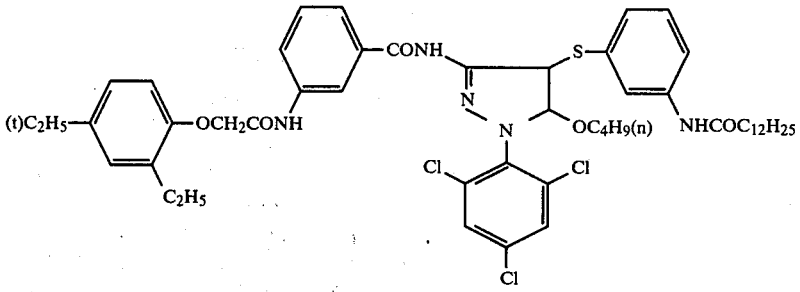

Comparison Coupler-5

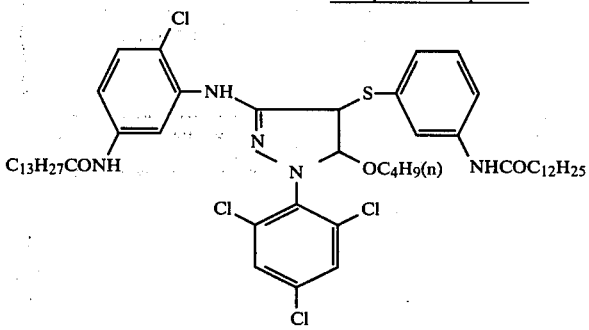

The samples were exposed through an optical wedge and then subjected to the following processing steps.

| Processing Step | Temperature (°C.) | Time |
|---|---|---|
| 1. Color development | 38 | 3 min 15 sec |
| 2. Bleaching | " | 6 min 30 sec |
| 3. Washing with water | " | 2 min |
| 4. Fixing | " | 4 min |
| 5. Washing with water | " | 4 min |
| 6. Stabilizing bath | " | 1 min |

The processing solutions used had the following compositions.

| Color Developer Solution | |
|---|---|
| 4-Amino-N-ethyl-N-(β-methanesulfonamidoethyl)aniline Monosulfate | g |
| Sodium Sulfite | 5 g |
| Hydroxylamine Sulfate | 2 g |
| Potassium Carbonate | 30 g |
| Potassium Hydrogen Carbonate | 1.2 g |
| Potassium Bromide | 1.2 g |
| Sodium Chloride | 0.2 g |
| Trisodium Nitrilotriacetate | 1.2 g |
| Water to make | 1 l (pH 10.1) |

| Bleaching Solution | |
|---|---|
| Iron (III) Ammonium Ethylenediaminetetraacetate | 100 g |
| Disodium Ethylenediaminetetraacetate | 10 g |
| Potassium Bromide | 150 g |
| Glacial Acetic Acid | 10 g |
| Aqueous Ammonia to adjust pH to 6.0 | |
| Water to make | 1 l |

| Fixing Solution | |
|---|---|
| Ammonium Thiosulfate | 150 g |
| Sodium Sulfite | 10 g |
| Sodium Hydrogen Sulfite | 2.5 g |
| Water to make | 1 l (pH 6.0) |

| Stabilizing Bath | |
|---|---|
| Formalin (37%) | 5 ml |
| Fuji Drywell | 3 ml |
| Water to make | 1 l |

After the above-described processing, optical densities of these samples were measured using green light and fog values and sensitivities based on the ASA sensitivity indication method were determined. Then, a ratio of sensitivity of a sample containing only the additive (for example, Sample N) to that of a sample neither containing the additive nor the hydroquinone compound (for example, Sample N') (this ratio is referred to Sensitivity-1/Sensitivity-2), and a ratio of sensitivity of a sample containing both the additive and the hydroquinone compound (for example, Sample A") to that of a sample neither containing the additive nor the hydroquinone compound (for example, Sample A') (referred to Sensitivity-3/Sensitivity-2) were determined. The results are shown in Table 4 below.

TABLE 4

| Sample | Components | | | Fog Value | Sensitivity-1/Sensitivity-2 | Sensitivity-3/Sensitivity-2 |
|---|---|---|---|---|---|---|
| N' | Coupler-1 | — | — | 0.14 | | |
| N | " | Add-3 | — | 0.28 | 1.35 | |
| N" | " | " | HQ-1 | 0.13 | | 1.26 |
| O' | Coupler-3 | — | — | 0.14 | | |
| O | " | Add-3 | — | 0.25 | 1.45 | |
| O" | " | " | HQ-1 | 0.14 | | 1.32 |
| P' | Coupler-12 | — | — | 0.15 | | |
| P | " | Add-3 | — | 0.30 | 1.51 | |
| P" | " | " | HQ-1 | 0.15 | | 1.38 |
| Q' | Coupler-12 | — | — | 0.15 | | |
| Q | " | Add-7 | — | 0.32 | 1.52 | |
| Q" | " | " | HQ-1 | 0.15 | | 1.37 |
| R' | Comparison Coupler 1 | — | — | 0.10 | | |
| R | Comparison Coupler 1 | Add-3 | — | 0.15 | 1.05 | |
| R" | Comparison Coupler 1 | " | HQ-1 | 0.06 | | 1.05 |
| S' | Comparison Coupler 4 | — | — | 0.08 | | |
| S | Comparison Coupler 4 | Add-3 | — | 0.10 | 1.00 | |
| S" | Comparison Coupler 4 | " | HQ-1 | 0.05 | | 1.02 |
| T' | Comparison Coupler 8 | — | — | 0.09 | | |
| T | Comparison Coupler 8 | Add-3 | — | 0.11 | 1.05 | |
| T" | Comparison Coupler 8 | " | HQ-1 | 0.05 | | 1.05 |

From the results shown in Table 4, it is apparent that in the cases of the comparison couplers, that is, the relatively low-activity oxy-coupling-off type couplers and the 4,5-disubstituted pyrazole type couplers, the increase in sensitivity is small due to the addition of the phenidone compound, although the increase in fog is also small.

On the other hand, in the cases of the high-activity alkylthio-coupling-off type couplers according to the present invention, the increase in sensitivity and fog due to the addition of the phenidone compound are large but the increase in sensitivity can be maintained as well as controlling the fog by the addition of the fog preventing agent.

Furthermore, Samples N, N', N", P, P', and P" were stored under typical storage conditions (at 25° C. and 60% RH) for 3 months, and then subjected to exposure and development processing. The maximum densities of magenta color images thus-obtained were compared with the maximum densities of magenta color images formed from the samples just after preparation. The results are shown in Table 5 below.

TABLE 5

| Sample | Fog* | Maximum Color Density after Storage / Maximum Color Density just after Coating |
|---|---|---|
| N' | 0.14 | 0.89 |
| N | 0.28 | 0.99 |
| N" | 0.13 | 0.99 |
| P' | 0.15 | 0.85 |
| P | 0.30 | 0.97 |
| P" | 0.15 | 0.98 |

*Fog did not change after the storage.

From the results shown in Table 5, it is apparent that the samples of the present invention have a low level of fog and excellent storability.

EXAMPLE 4

Samples as described in Example 3 containing the same coupler and additives, except using a silver iodobromide emulsion containing 3 mol% of iodide (containing 100 g of silver halide and 70 g of gelatin per 1 kg of emulsion) in place of the silver halide emulsion used in Example 3, were prepared and subjected to reversal processing as described below. It is apparent that the increase in fog due to the addition of the phenidone compound to the S-coupling-off type 2-equivalent magenta coupler is effectively prevented without accompanying large desensitization.

| Processing Step | Temperature (°C.) | Time (minutes) |
|---|---|---|
| 1. First development | 38 | 3 |
| 2. Washing with water | " | 1 |
| 3. Reversal | " | 2 |
| 4. Color development | " | 6 |
| 5. Stopping | " | 2 |
| 6. Bleaching | " | 6 |
| 7. Fixing | " | 4 |
| 8. Washing with water | " | 4 |
| 9. Stabilizing | " | 1 |
| 10. Drying | | |

The processing solutions used had the following compositions.

| First Developer Solution | |
|---|---|
| Water | 800 ml |
| Sodium Tetrapolyphosphate | 2.0 g |
| Sodium Hydrogen Sulfite | 8.0 g |
| Sodium Sulfite | 37.0 g |
| 1-Phenyl-3-pyrazolidone | 0.35 g |
| Hydroquinone | 5.5 g |
| Sodium Carbonate Monohydrate | 28.0 g |
| Potassium Bromide | 1.5 g |
| Potassium Iodide | 13.0 mg |
| Sodium Thiocyanate | 1.4 g |
| Water to make | 1 l |

| Reversal Solution | |
|---|---|
| Water | 800 ml |
| Hexasodium Nitrilo-N,N,N-trimethylene Phosphonic Acid | 3.0 g |
| Stannous Chloride Dihydrate | 1.0 g |
| Sodium Hydroxide | 8.0 g |
| Glacial Acetic Acid | 15.0 ml |
| Water to make | 1 l |

| Color Developer Solution | |
|---|---|
| Water | 800 ml |
| Sodium Tetrapolyphosphate | 2.0 g |
| Benzyl Alcohol | 5.0 ml |
| Sodium Sulfite | 7.5 g |
| Trisodium Phosphate (12 hydrate) | 36.0 g |
| Potassium Bromide | 1.0 g |
| Potassium Iodide | 90.0 mg |
| Sodium Hydroxide | 3.0 g |
| Citrazinic Acid | 1.5 g |
| 4-Amino-3-methyl-N-ethyl-N-(β-hydroxyethyl)aniline Sesquisulfate Monohydrate | 11.0 g |
| Ethylenediamine | 3.0 g |
| Water to make | 1.0 l |

| Stopping Solution | |
|---|---|
| Water | 800 ml |
| Glacial Acetic Acid | 5.0 ml |
| Sodium Hydroxide | 3.0 g |
| Dimethylaminoethaneisothiourea Dihydrochloride | 1.0 g |
| Water to make | 1 l |

| Bleaching Solution | |
|---|---|
| Water | 800 ml |
| Sodium Ethylenediaminetetraacetate Dihydrate | 2.0 g |
| Ammonium Iron (III) Ethylenediaminetetraacetate Dihydrate | 120.0 g |
| Potassium Bromide | 100.0 g |
| Water to make | 1 l |

| Fixing Solution | |
|---|---|
| Water | 800 ml |
| Ammonium Thiosulfate | 80.0 g |
| Sodium Sulfite | 5.0 g |
| Sodium Hydrogen Sulfite | 5.0 g |
| Water to make | 1 l |

| Stabilizing Bath | |
|---|---|
| Water | 800 ml |
| Formalin (37%) | 5.0 ml |
| Fuji Drywell | 5.0 ml |
| Water to make | 1.0 l |

While the invention has been described in detail and with reference to specific embodiments thereof, it will be apparent to one skilled in the art that various changes and modifications can be made therein without departing from the spirit and scope thereof.

What is claimed is:

1. A color photographic light-sensitive material comprising a support having thereon a silver halide emulsion layer containing at least one coupler represented by formula (I)

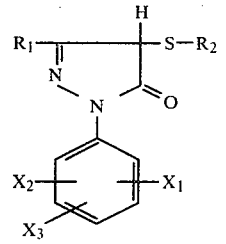

(I)

wherein $R_1$ represents an anilino group, an acylamino group- or a uriedo group, $R_2$ represents an aralkyl group, an alkyl group or an alkenyl group, $X_1$, $X_2$, and $X_3$ each represents hydrogen, an alkyl group, a halogen atom, an alkoxy group, an aryloxy group, an acylamino group, a carbamoyl group, a sulfamoyl group, a sulfonyl group, or a cyano group, and at least one of said silver halide emulsion layer and a hydrophilic colloid layer adjacent thereto containing a 1-phenyl-3-pyrazolidone compound having a diffusion resistant group in the presence of an organic solvent having a high boiling point for a photographic additive.

2. A color photographic light-sensitive material as in claim 1, wherein $R_1$ represents a phenylamino group, an o-chlorophenylamino group, a 2,4-dichlorophenylamino group, a 2,4-dichloro-5-methoxyphenylamino group, a 2-chloro-5-tetradecanamidophenylamino group, a 2-chloro-5-[α-(2,4-di-t-amylphenoxy)butyramido]phenylamino group, a 2-chloro-5-[(3-octadecenyl)succinimido]phenylamino group, or a 2-chloro-5-{α-[(3-t-butyl-4-hydroxy)phenoxy]tetradecanamido}phenylamino group.

3. A color photographic light-sensitive material as in claim 1, wherein $R_1$ represents an acetylamino group, a butyramido group, an α-(3-pentadecylphenoxy)butyramido group, an n-tetradecanamido group, an α-(2,4-di-t-amylphenoxy)butyramido group, a 3-[α-(2,4-di-t-amylphenoxy)butyramido]benzamido group, a benzamido group, or a 3-acetylamidobenzamido group.

4. A color photographic light-sensitive material as in claim 1, wherein $R_1$ represents a phenylureido group, a methylureido group, or a 3-[α-(2,4-di-t-amylphenoxy)butyramido]phenylureido group.

5. A color photographic light-sensitive material as in claim 1, wherein $R_2$ represents an alkyl group having from 1 to 22 carbon atoms.

6. A color photographic light-sensitive material as in claim 1, wherein said alkyl group, aralkyl group, or alkenyl group represented by $R_2$ is substituted with at least one member selected from the group consisting of a halogen atom, a nitro group, a cyano group, an aryl group, an alkoxy group, an aryloxy group, a carboxyl group, an alkylcarbonyl group, an arylcarbonyl group, an alkoxycarbonyl group, an aryloxycarbonyl group, an acyloxy group, a sulfamoyl group, a carbamoyl group, an acylamino group, a diacylamino group, a ureido group, a thioureido group, a urethane group, a thiourethane group, a sulfonamido group, a heterocyclic group, an arylsulfonyloxy group, an alkylsulfonyloxy group, an arylsulfonyl group, an alkylsulfonyl group, an arylthio group, an alkylthio group, an alkylsulfinyl group, an arylsulfinyl group, an alkylamino group, a dialkylamino group, an anilino group, an N-arylanilino group, an N-alkylanilino group, an N-acylanilino group, and a hydroxy group.

7. A color photographic light-sensitive material as in claim 1, wherein $R_2$ represents an alkyl group having from 1 to 5 carbon atoms.

8. A color photographic light-sensitive material as in claim 1, wherein $X_1$, $X_2$, and $X_3$ each represents a chlorine atom.

9. A color photographic light-sensitive material as in claim 1, wherein said 1-phenyl-3-pyrazolidone compound is present in an amount of from 0.005 to 10 mol per mol of said coupler.

10. A color photographic light-sensitive material as in claim 1, wherein said 1-phenyl-3-pyrazolidone compound is present in an amount of from 0.01 to 2 mol per mol of said coupler.

11. A color photographic light-sensitive material as in claim 1, wherein said 1-phenyl-3-pyrazolidone compound is represented by formula (II)

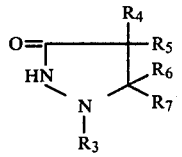

(II)

wherein $R_3$ represents an aryl group; $R_4$, $R_5$, $R_6$, and $R_7$ each represents hydrogen, an alkyl group, an aryl group, an alkoxy group, an aryloxy group, or an aralkyloxy group; and when $R_4$, $R_5$, $R_6$, and $R_7$ each represents a group having less than 6 carbon atoms, $R_3$ represents an aryl group having a substituent group having at least 6 carbon atoms, and when $R_3$ represents an aryl group having a substituent group having less than 6 carbon atoms, at least one of $R_4$, $R_5$, $R_6$, and $R_7$ represents a group having at least 6 carbon atoms.

12. A color photographic light-sensitive material as in claim 11, wherein $R_3$ represents an aryl group which may be substituted with at least one member selected from a halogen atom, an alkyl group, an aryl group, an aralkyl group, an alkoxy group, an aryloxy group, an alkylthio group, an arylthio group, an acylamino group, a nitro group, a sulfonamino group, a cyano group, a hydroxy group, a sulfo group, a carboxy group, and an alkyloxycarbonyl group.

13. A color photographic light-sensitive material as in claim 11, wherein $R_3$ represents an aryl group which may be substituted with at least one member selected from an alkoxy group, an aryloxy group, an alkylthio group, and an arylthio group.

14. A color photographic light-sensitive material as in claim 11, wherein said alkyl group represented by $R_4$, $R_5$, $R_6$, and $R_7$ are alkyl groups which may be substituted with at least one member selected from an aryl group, a hydroxy group, a halogen atom, an acyloxy group, an alkoxy group, an aryloxy group, an alkylthio group, an arylthio group, and a heterocyclic group.

15. A color photographic light-sensitive material as in claim 11, wherein said aryl group represented by $R_4$, $R_5$, $R_6$, and $R_7$ are aryl groups which may be substituted with at least one member selected from an alkyl group, an aryl group, a halogen atom, an alkoxy group, an aryloxy group, an alkylthio group, an arylthio group, an amino group, an alkylamino group, an acylamino group, a sulfonamino group, a cyano group, a nitro group, and a hydroxy group.

16. A color photographic light-sensitive material as in claim 1, wherein said silver halide emulsion layer is a green-sensitive silver halide emulsion layer.

17. A color photographic light-sensitive material as in claim 16, wherein said photographic material further contains at least one blue-sensitive silver halide emulsion layer and at least one red-sensitive silver halide emulsion layer.

18. A color photographic light-sensitive material as in claim 17, wherein said blue-sensitive silver halide emulsion layer contains at least one yellow-dye-forming coupler and said red-sensitive silver halide emulsion layer contains at least one cyan-dye-forming coupler.

19. A color photographic light-sensitive material as in claim 1, wherein said 1-phenyl-3-pyrazolidone compound is present in said silver halide emulsion layer.

20. A color photographic light-sensitive material as in claim 1, wherein said coupler and said 1-phenyl-3-pyrazolidone compound are dissolved in said organic solvent and dispersed in said silver halide emulsion layer.

21. A color photographic light-sensitive material as in claim 1, wherein said color photographic light-sensitive material comprising a support having thereon a silver halide emulsion layer containing at least one coupler represented by formula (I)

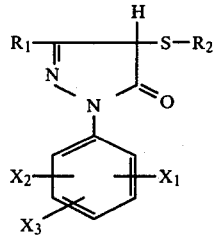

(I)

wherein $R_1$ represents an anilino group, an acylamino group, or a ureido group, $R_2$ represents an aralkyl group, an alkyl group, or an alkenyl group, $X_1$, $X_2$, and $X_3$ each represents hydrogen, an alkyl group, a halogen atom, an alkoxy group, an aryloxy group, an acylamino group, a carbamoyl group, a sulfamoyl group, a sulfonyl group, or a cyano group, and at least one of said silver halide emulsion layer and a hydrophilic colloid layer adjacent thereto containing a 1-phenyl-3-pyrazolidone compound having a diffusion resistant group and a hydroquinone compound represented by formula (III)

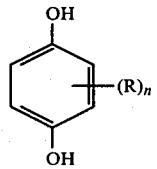

(III)

wherein R represents a substituted or unsubstituted alkyl group having from 8 to 30 carbon atoms, a substituted or unsubstituted aryl group, an alkoxy group, an aryloxy group, a carbamoyl group, a sulfamoyl group, an alkoxycarbonyl group or an aryloxycarbonyl group, n represents an integer of from 1 to 4, and when n represents an integer of more than 2, R may represent the same or different groups, in the presence of an organic solvent having a high boiling point for a photographic additive.

22. A color photographic light-sensitive material as in claim 21, wherein said alkyl or aryl group represented by R in formula (III) may be substituted with at least one member selected from a halogen atom, an alkyl group, an aryl group, an alkoxy group, an aryloxy group, a carboxy group, an alkoxycarbonyl group, an aryloxycarbonyl group, an acyl group, an acyloxy group, a carbamoyl group, a sulfo group, a sulfamoyl group, a sulfonamido group, an N-alkylamino group, an N-arylamino group, an acylamino group, an imido group, or a hydroxy group.

23. A color photographic light-sensitive material as in claim 1, wherein said coupler and said 1-phenyl-3-pyrazolidone compound are dissolved in said organic solvent and dispersed in said silver halide emulsion layer.

24. A color photographic light-sensitive material as in claim 1, wherein said coupler, said 1-phenyl-3-pyrazolidone compound, and said hydroquinone compound are dissolved in said organic solvent and dispersed in said silver halide emulsion layer.

* * * * *